US007121019B2

(12) United States Patent
Frederiksen et al.

(10) Patent No.: US 7,121,019 B2
(45) **Date of Patent: *Oct. 17, 2006**

(54) FOOTWEAR SYSTEM

(76) Inventors: Ben G. Frederiksen, 600 Pacific Coast Highway, #216, Seal Beach, CA (US) 90740; Gayle Trenberth, 600 Pacific Coast Highway, #216, Seal Beach, CA (US) 90740

( * ) Notice: Subject to any disclaimer, the term of this patent is extended or adjusted under 35 U.S.C. 154(b) by 114 days.

This patent is subject to a terminal disclaimer.

(21) Appl. No.: 10/212,306

(22) Filed: Aug. 5, 2002

(65) Prior Publication Data

US 2003/0029056 A1 Feb. 13, 2003

Related U.S. Application Data

(63) Continuation-in-part of application No. 09/928,382, filed on Aug. 13, 2001, now Pat. No. 6,625,904.

(51) Int. Cl.
*A43B 3/12* (2006.01)

(52) U.S. Cl. ..... 36/11.5

(58) Field of Classification Search ..... 36/9 R, 36/9 A, 11.5, 31, 71, 94
See application file for complete search history.

(56) References Cited

U.S. PATENT DOCUMENTS 4,387,516 A * 6/1983 Laux ..... 36/43
6,526,676 B1 * 3/2003 Ledergerber ..... 36/11.5
6,625,904 B1 * 9/2003 Frederiksen et al. ..... 36/11.5

* cited by examiner

*Primary Examiner*—Mickey Yu
*Assistant Examiner*—Jerrold Johnson
(74) *Attorney, Agent, or Firm*—Edward P. Dutkiewicz

(57) ABSTRACT

A footwear system comprises an essentially oblong platform formed of an elastomeric material having a first aperture offset from a long axis of the platform adjacent to a forward end. A U-shaped cut through a rearward end of the platform forms a first strap disposed toward the forward end with a second aperture through a midpoint of the first strap and aligned with the first aperture. A fastening member passes through the first and second apertures coupling the first strap and the platform and thereby forming two separate passageways. A second strap formed of an elastic material has a first attachment means coupling a forward end of the second strap and the platform adjacent to the fastening member. A second attachment means couples a rearward end of the second strap and the platform adjacent to a lateral edge of the platform.

6 Claims, 8 Drawing Sheets

FIG 1
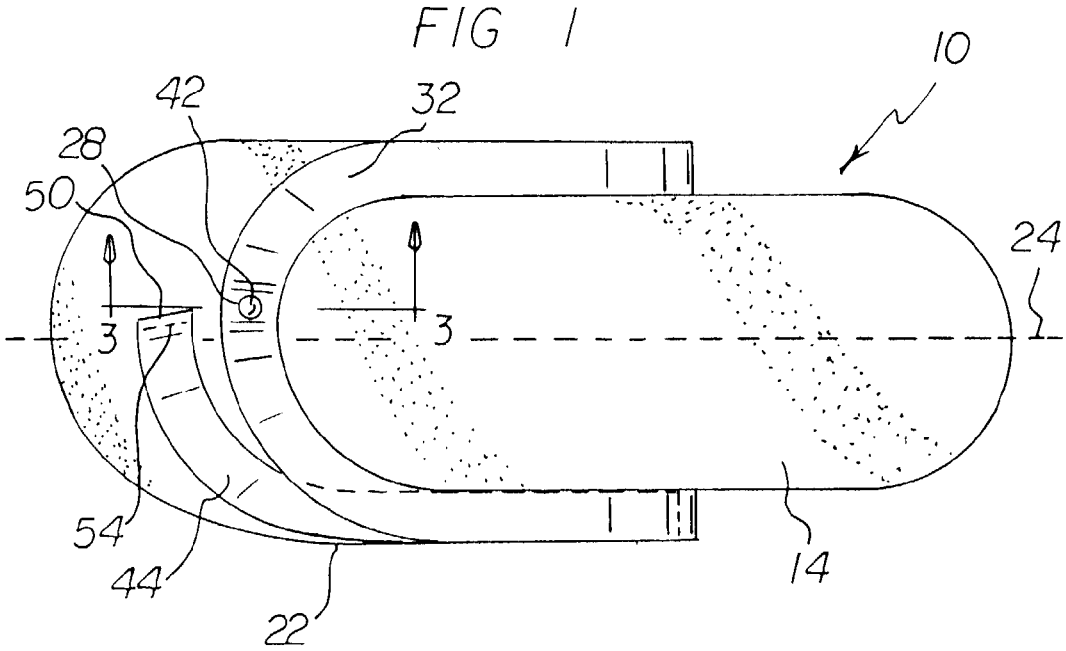
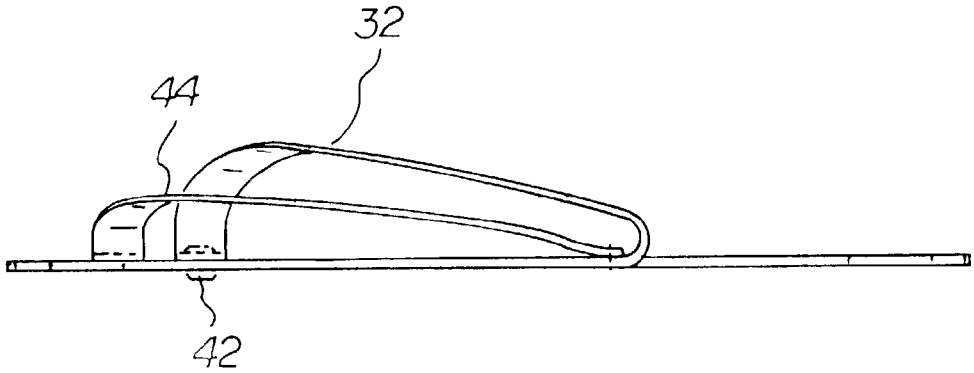
FIG 2

FIG 3
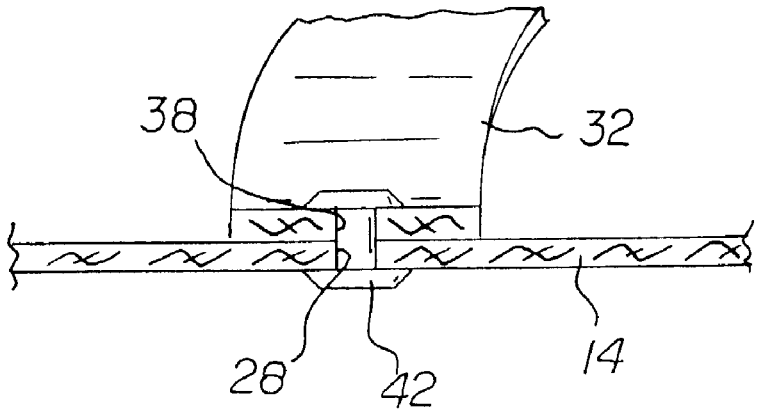
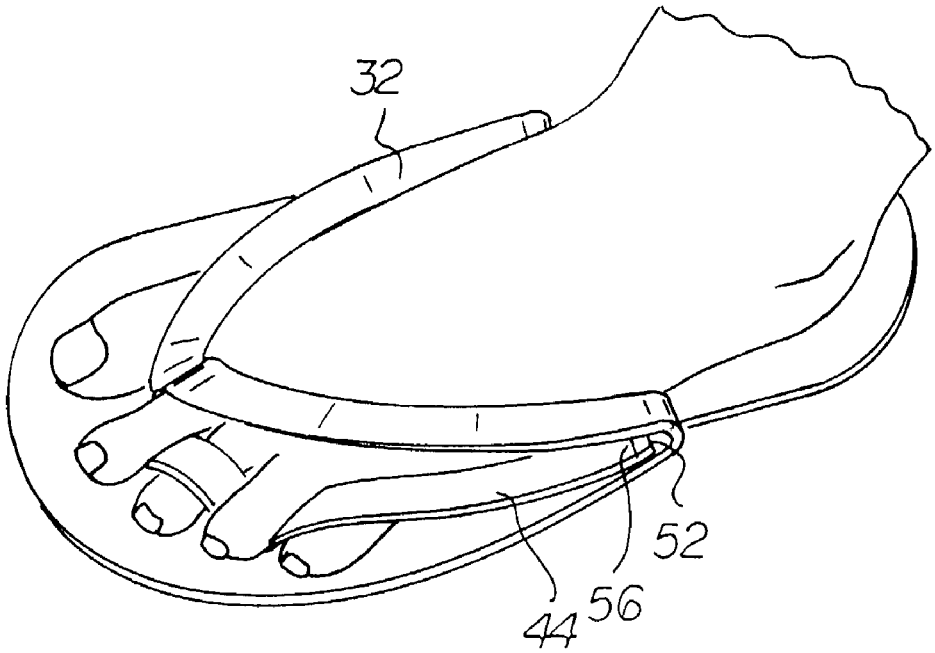
FIG 4

FIG 6
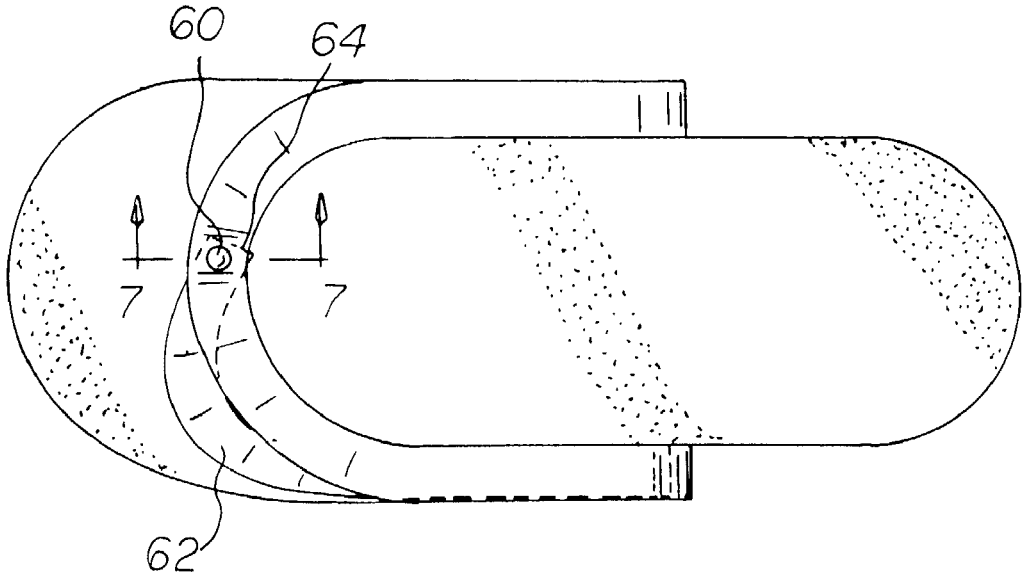
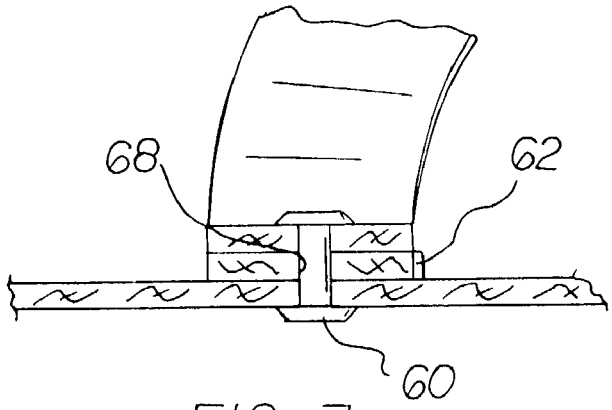
FIG 7

FIG 8
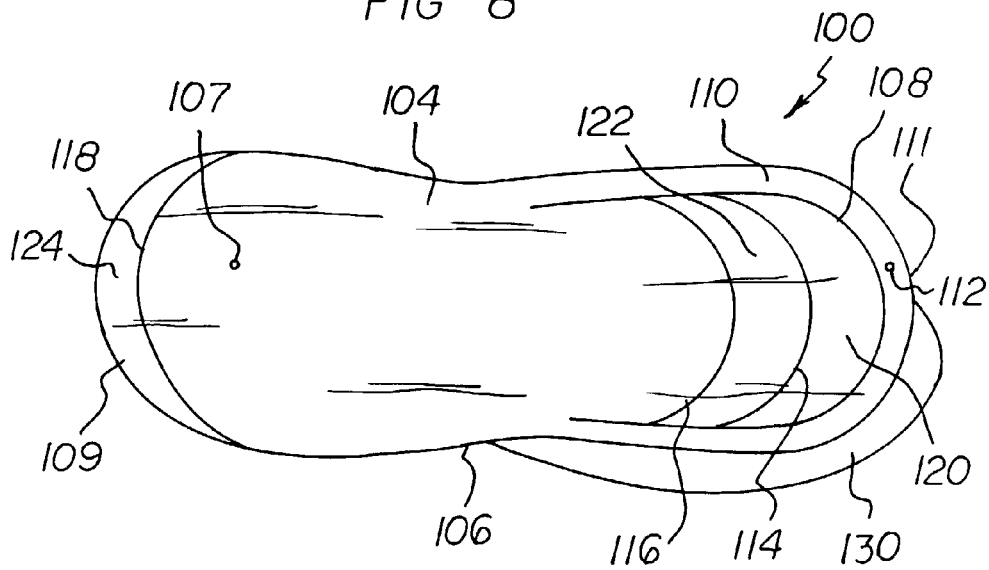
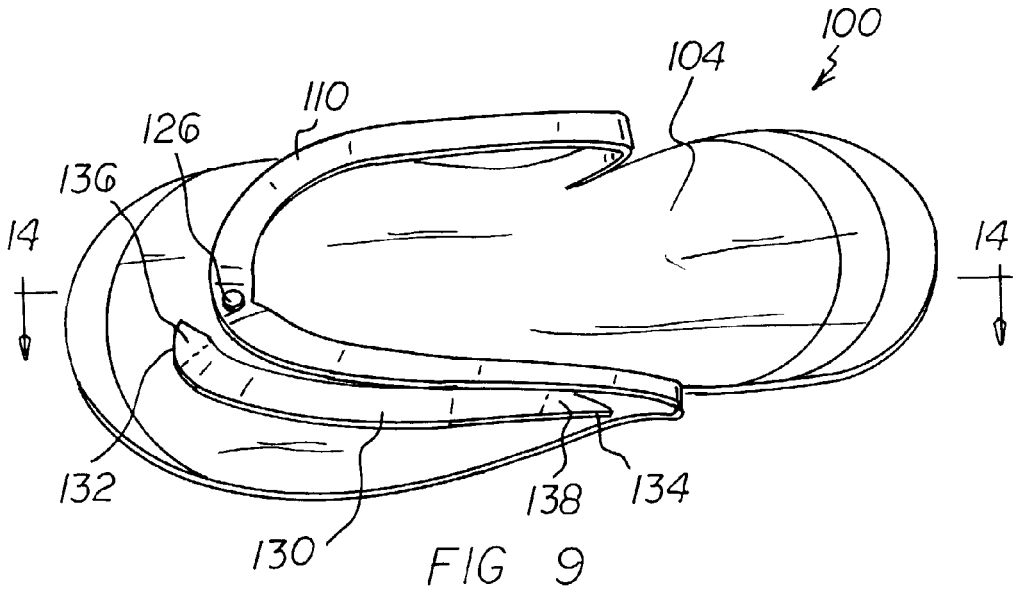
FIG 9

FIG 10
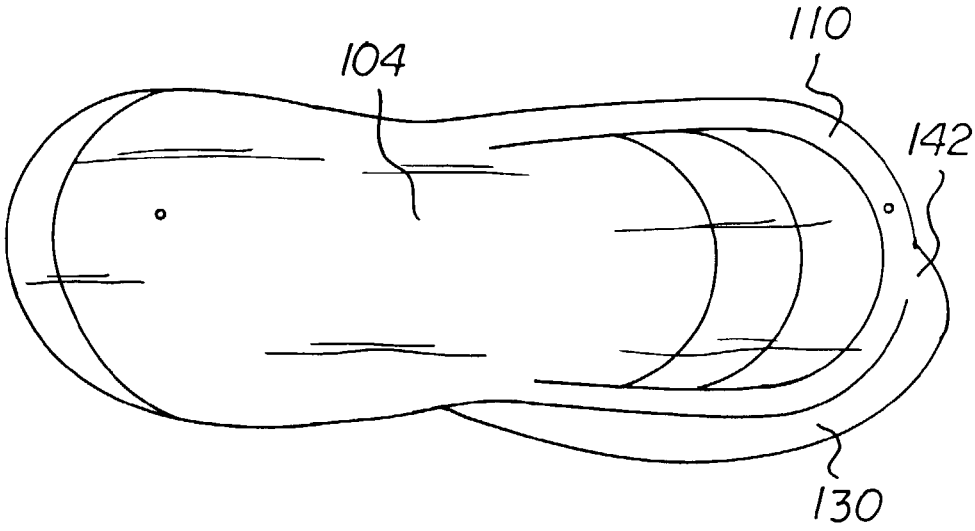
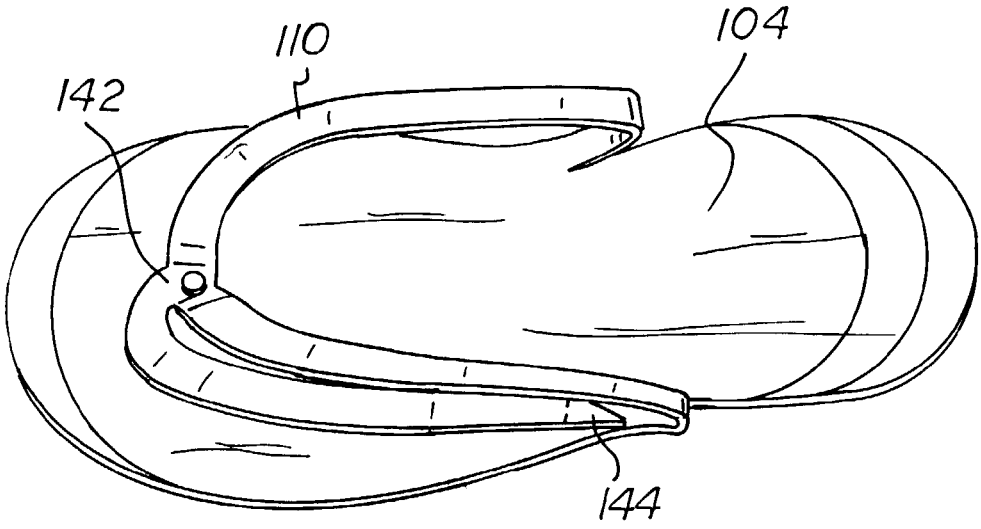
FIG 11

FIG 12
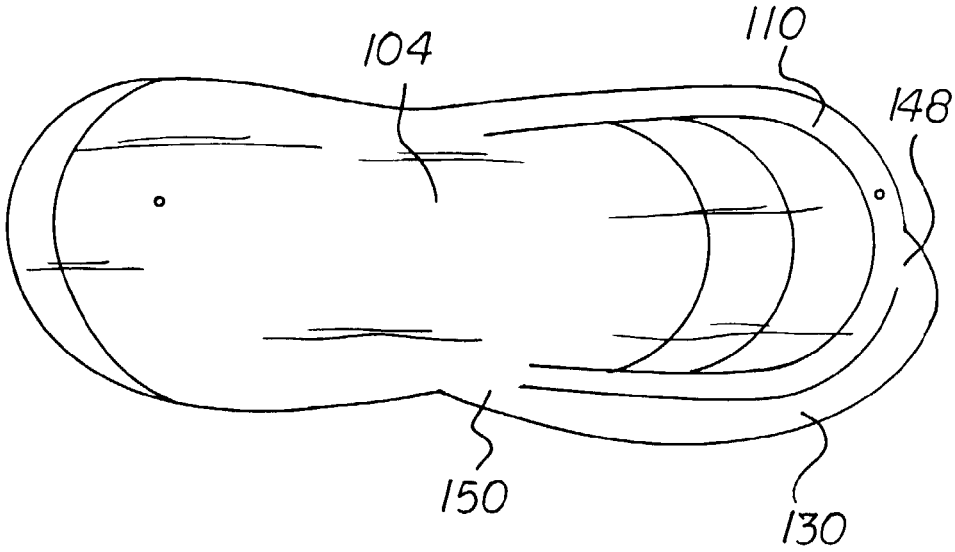
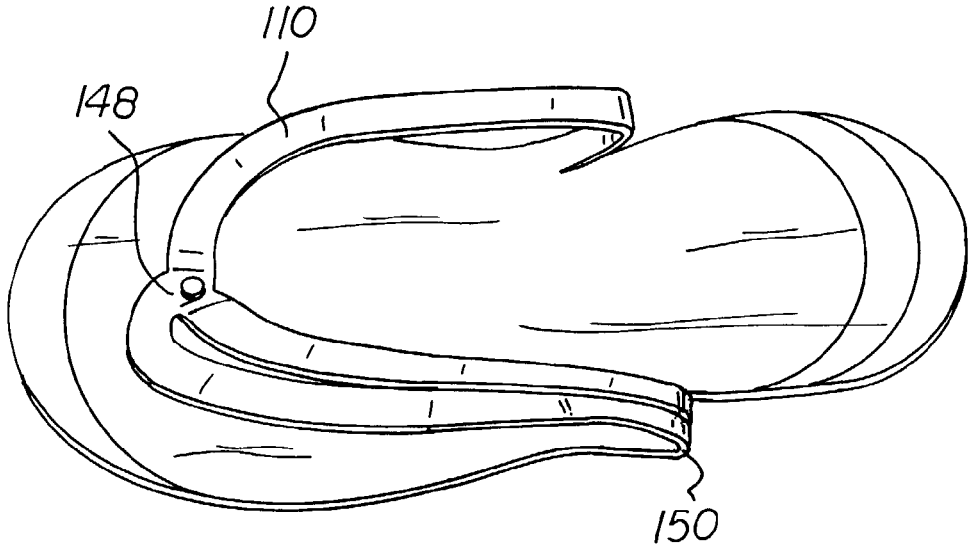
FIG 13

FOOTWEAR SYSTEM

RELATED APPLICATION

This application is a continuation-in-part of application Ser. No. 09/928,382 filed Aug. 13, 2001 now U.S. Pat. No. 6,625,904.

BACKGROUND OF THE INVENTION

1. Field of the Invention

The present invention relates to a footwear system and more particularly pertains to protecting a wearer's foot by retaining the footwear in place in a safe, comfortable and convenient manner.

2. Description of the Prior Art

The use of shoes, sandals and other footwear of known designs and configurations is known in the prior art. More specifically, shoes, sandals and other footwear of known designs and configurations previously devised and utilized for the purpose of rendering footwear safer or more comfortable through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 1,867,679 to Riehle et al discloses a foot corrective sandal. U.S. Pat. No. 2,751,693 to Baker discloses a toe spacing sandal. U.S. Pat. No. 5,802,737 to Beppu discloses a thong type sandal. Lastly, U.S. Pat. No. 5,870,837 discloses a combination pedicure.

While these devices fulfill their respective, particular objectives and requirements, the aforementioned patents do not describe a footwear system that allows protecting a wearer's foot by retaining the footwear in place in a safe, comfortable and convenient manner.

In this respect, the footwear system according to the present invention substantially departs from the conventional concepts and designs of the prior art, and in doing so provides an apparatus primarily developed for the purpose of protecting a wearer's foot by retaining the footwear in place in a safe, comfortable and convenient manner.

Therefore, it can be appreciated that there exists a continuing need for a new and improved footwear system which can be used for protecting a wearer's foot by retaining the footwear in place in a safe, comfortable and convenient manner. In this regard, the present invention substantially fulfills this need.

SUMMARY OF THE INVENTION

In view of the foregoing disadvantages inherent in the known types of shoes, sandals and other footwear of known designs and configurations now present in the prior art, the present invention provides an improved footwear system. As such, the general purpose of the present invention, which will be described subsequently in greater detail, is to provide a new and improved footwear system and method which has all the advantages of the prior art and none of the disadvantages.

To attain this, the present invention essentially comprises an essentially oblong platform. The platform is formed of an elastomeric material. The platform may be fabricated of a biodegradable bio-plastic. The platform has a first aperture offset from a long axis of the platform adjacent to a forward end. A U-shaped cut is provided through a rearward end of the platform. The U-shaped cut forms a first strap. The first strap is disposed toward a forward end of the platform. A second aperture is formed through a midpoint of the first strap and is aligned with the first aperture. Next provided is a fastening member. The fastening member may be a rivet, or any other form of fastener. The fastening member passes through the first and second apertures coupling the first strap and the platform. In this manner two separate passageways are formed. Lastly provided is a second strap. The second strap is formed of an elastic material and has a tensile strength the same as the first strap. The second strap has a forward end and a rearward end. A first attachment stitch couples the forward end of the second strap and the platform adjacent to the fastening member but forwardly thereof. A second attachment stitch is provided. The second attachment stitch couples the rearward end of the second strap and a midpoint of the platform adjacent to a lateral edge of the platform. In this manner a user may place the fifth, fourth, third and second toes on alternate surfaces of the second strap in a serpentine orientation. The toes are then separated and convenient access is provided to the toes and toenails of the user's foot for pedicure operations such as painting the user's toenails. Following the pedicure, the sandal may be worn by the user. It provides a safe and sturdy walking surface and protects the toes and toenails until it is later disposed of, either at a spa where the pedicure services are rendered, or later at the home of the user should they wish to protect the toes and toenails for a longer period of time.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved footwear system which has all of the advantages of the prior art shoes, sandals and other footwear of known designs and configurations and none of the disadvantages.

It is another object of the present invention to provide a new and improved footwear system which may be easily and efficiently manufactured and marketed.

It is further an object of the present invention to provide a new and improved footwear system which is of durable and reliable constructions.

An even further object of the present invention is to provide a new and improved footwear system which is susceptible of a low cost of manufacture with regard to both materials and labor, and which accordingly is then susceptible of low prices of sale to the consuming public, thereby making such footwear system economically available to the buying public.

Even still another object of the present invention is to provide a footwear system for protecting a wearer's foot by retaining the footwear in place in a safe, comfortable and convenient manner.

Lastly, it is an object of the present invention to provide a new and improved footwear system comprising an essentially oblong platform formed of an elastomeric material having a first aperture offset from a long axis of the platform adjacent to a forward end. A U-shaped cut through a rearward end of the platform forms a first strap disposed toward the forward end with a second aperture through a midpoint of the first strap and aligned with the first aperture. A fastening member passes through the first and second apertures coupling the first strap and the platform and thereby forming two separate passageways. A second strap formed of an elastic material has a first attachment means coupling a forward end of the second strap and the platform adjacent to the fastening member. A second attachment means couples a rearward end of the second strap and the platform adjacent to a lateral edge of the platform.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a top elevational view of the new and improved footwear system constructed in accordance with the principles of the present invention.

FIG. 2 is a side elevational view of the footwear system shown in FIG. 1.

FIG. 3 is a cross-sectional view taken along line 3—3 of FIG. 1.

FIG. 4 is a perspective illustration of the sandal receiving a wearer's foot.

FIG. 6 is a top elevational view similar to FIG. 1 but illustrating an alternate embodiment of the invention.

FIG. 7 is a cross-sectional view taken alone line 7—7 of FIG. 6.

FIG. 8 is a plan view of the platform portion of the footwear system constructed in accordance with the principles of the present invention.

FIG. 9 is a top elevational view similar to FIG. 8 but illustrating the platform in a folded orientation for use.

FIG. 10 is a plan view of an alternate embodiment of the invention.

FIG. 11 is a perspective view of an alternate embodiment of the invention.

FIG. 12 is a view similar to FIG. 8 but illustrating an alternate embodiment of the invention.

FIG. 13 is a view similar to FIG. 9 but illustrating an alternate embodiment of the invention.

The same reference numerals refer to the same parts throughout the various Figures.

DESCRIPTION OF THE PREFERRED EMBODIMENT

Figure 5:
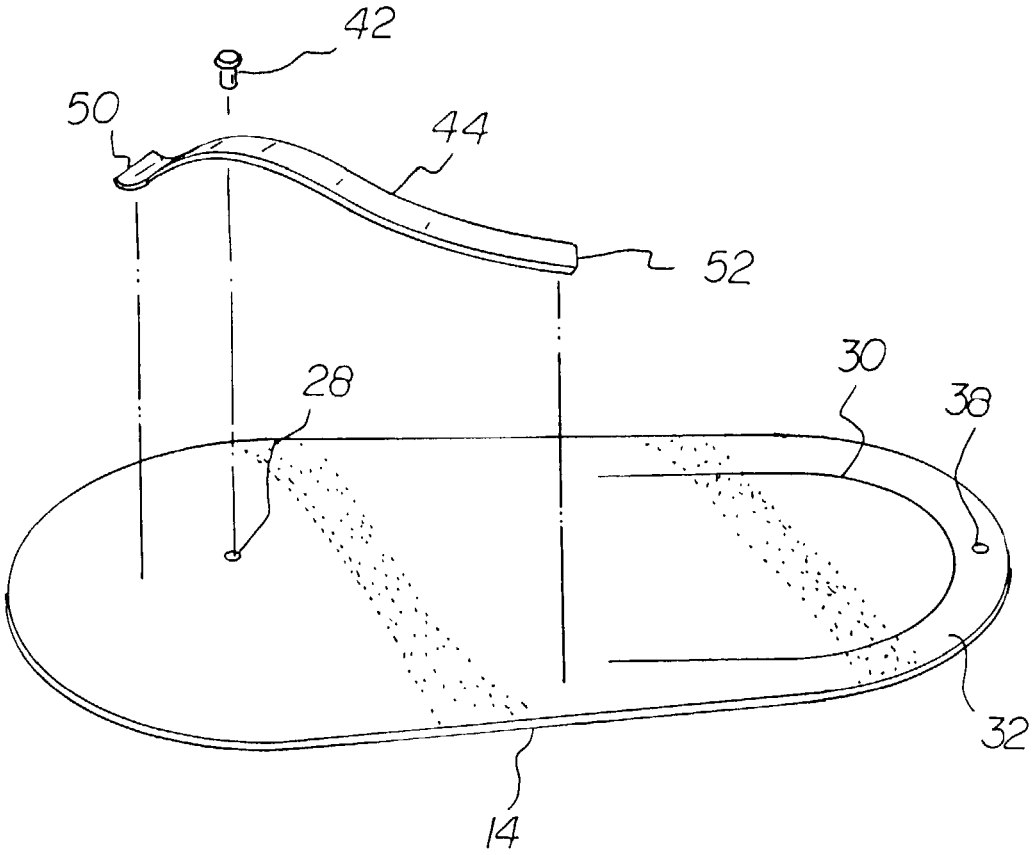
FIG. 5 is an exploded perspective view of the footwear system shown in the prior figures.
Figure 14:
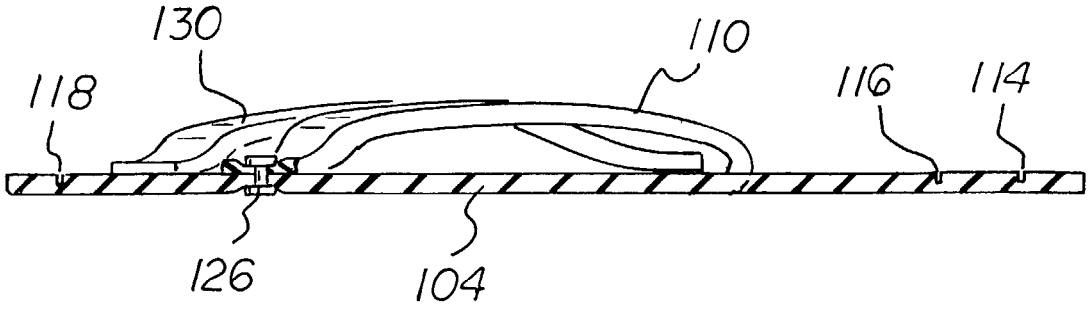
FIG. 14 is a cross sectional view taken along line 14—14 of FIG. 13.

With reference now to the drawings, and in particular to FIG. 1 thereof, the preferred embodiment of the new and improved footwear system embodying the principles and concepts of the present invention and generally designated by the reference numeral 10 will be described.

The present invention, the footwear system 10 is comprised of a plurality of components. Such components in their broadest context include a platform, a fastening member, and a second strap. Such components are individually configured and correlated with respect to each other so as to attain the desired objective.

First provided is an essentially oblong platform 14. The platform is formed of an elastomeric material. The platform may be fabricated of a biodegradable bio-plastic. The platform has a first aperture 28 offset from a long axis 24 of the platform adjacent to a forward end. A U-shaped cut is provided 30 through a rearward end of the platform. The U-shaped cut forms a first strap 32. The first strap is disposed toward a forward end of the platform. A second aperture 38 is formed through a midpoint of the first strap and is aligned with the first aperture.

Next provided is a fastening member 42. The fastening member may be a rivet 60, or any other form of fastener. The fastening member passes through the first and second apertures coupling the first strap and the platform. In this manner two separate passageways are formed.

Lastly provided is a second strap 44. The second strap is formed of an elastic material and has a tensile strength the same as the first strap. The second strap has a forward end 50 and a rearward end 52. A first attachment stitch 54 couples the forward end of the second strap and the platform adjacent to the fastening member but forwardly thereof. A second attachment stitch 56 is provided. The second attachment stitch couples the rearward end of the second strap and the platform adjacent to a lateral edge of the platform. In this manner a user may place the fifth, fourth, third and second toes on alternate surfaces of the second strap in a serpentine orientation. The toes are then separated and convenient access is provided to the toes and toenails of the user's foot for pedicure operations such as painting the user's toenails.

In an alternate embodiment of the present invention, the first attachment means of the second strap 62 is a third aperture 68 adjacent to the forward end 64. The fastening member passes through the first, second, and third apertures thereby coupling the first strap, the second strap and the platform.

In another alternate embodiment of the invention, shown in FIGS. 8 and 9, a footwear system 100 comprises an essentially oblong platform 104, formed of an elastomeric material. The platform has a central tapered region 106, a forward end 109, and a rearward end 111. A first aperture 107 is provided adjacent to the forward end. A U-shaped cut 108 provided through the rearward end of the platform forms a first strap 110 disposed toward the forward end. A second aperture 112 through a midpoint of the first strap is aligned with the first aperture. A first rear U-shaped recess 114 is provided adjacent to the U-shaped cut. A second U-shaped recess 116 is provided adjacent to the first U-shaped recess. A front U-shaped recess 118 is provided adjacent to the forward end. The U-shaped recesses are adapted to optionally remove a first rearward piece 120, a second rearward piece 122, and a forward piece 124 from the sandal. The pieces are bent and torn from the platform to provide alternative sizes of the oblong platform.

Next provided in this embodiment is a fastening member 126. The fastening member passes through the first and second apertures coupling the first strap and the platform. In this manner two separate passageways are formed.

In this embodiment, a second strap 130 is formed of an elastic material. The second strap has a forward end 132 and a rearward end 134. A first attachment 136 couples the forward end of the second strap and the platform adjacent to the fastening member. A second attachment 138 couples the rearward end of the second strap and the platform adjacent to a lateral edge. In this manner a user may place his/her fifth, fourth, third and second toes contacting alternate surfaces of the second strap in a serpentine orientation. Note FIG. 4. The toes are thus separated and convenient access is allowed to the toenails of the user's foot for pedicure operations such as painting the user's toenails.

In still another alternate embodiment, shown in FIGS. 10 and 11, the first attachment 142 is comprised of the forward end of the second strap formed from a midpoint of the first strap and the second attachment 144 is comprised of the rearward end of the second strap coupled to the platform.

In a final embodiment, the first attachment 148 is comprised of the forward end of the second strap coupled to the first strap. The second attachment 150 is comprised of the rearward end of the second strap formed from a midpoint of the platform.

The whole concept is a spa sandal that can be converted to a pedicure sandal. It is inexpensive enough that spas and salons can give it away to their customers. It can be worn as a spa sandal, a thong sandal with two straps on one side, and one strap on another side of the foot. If using it for a pedicure, the second strap can be woven between the other toes to separate them. Spas and salons can pass the sandal out to their clients when they enter the spa. The clients wear the spa sandal walking around the spa, use the pedicure strap when getting the pedicure. While disposable, the sandal will be sturdy enough for the client to be able to walk out of the spa after a pedicure, do a few chores, take the sandal off after 2 hours, when the toenails are really dry, and then dispose of the sandal. In an alternate embodiment the platform may be formed of a biodegradable material.

The tear away lines of the alternate embodiments include a sonar/hot wire cutting system. In order to tear the sandal easily, it is bent over the tear off line, back and forth, two or three times, to break the material. After this bending, it can easily be torn off. The sandal is pressed with a hot wire cutting system to form the tear-off line. When the material is pressed with hot wire, the material changes in its characteristic and it becomes like paper. Therefore, before tearing it, it is much better if it is bent at the tear off line to its maximum position back and forth. One time bending upward and one time downward, the tear off line will be very easy to tear.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A footwear system for protecting a wearer's foot during and following pedicure operations by retaining the foot and toes in place in a safe, comfortable and convenient manner, comprising, in combination:

an essentially oblong platform formed of an elastomeric material with a central tapered region having a first aperture adjacent to a forward end, a U-shaped cut through a rearward end of the platform forming a first strap disposed toward the forward end with a second aperture through a midpoint of the first strap and aligned with the first aperture, a first rear U-shaped recess adjacent to the U-shaped cut and a second U-shaped recess adjacent to the first U-shaped recess, a front U-shaped recess adjacent to the forward end with the U-shaped recesses being adapted to optionally remove a first rearward piece, a second rearward piece and a forward piece from the sandal through bending and tearing to provide alternative sizes of the oblong platform;

a fastening member passing through the first and second apertures coupling the first strap and the platform together and thereby forming two separate passageways; and a second strap formed of an elastic material with a forward end and a rearward end, and with a first attachment coupling the forward end of the second strap and the platform adjacent to the fastening member and with a second attachment coupling the rearward end of the second strap and a midpoint of the platform adjacent to a lateral edge thereby enabling a user to place the fifth, fourth, third and second toes contacting alternate surfaces of the second strap in a serpentine orientation to separate and allow convenient access to the toenails of the user's foot for pedicure operations such as painting the user's toenails.

2. A footwear system comprising, in combination:

an essentially oblong platform formed of an elastomeric material having a first aperture adjacent to a forward end, a U-shaped cut through a rearward end of the platform forming a first strap disposed toward the forward end with a second aperture in the first strap and aligned with the first aperture, a first rear U-shaped recess adjacent U-shaped cut and a second U-shaped recess adjacent to the first U-shaped recess and a front U-shaped recess being adjacent to the forward end;

a fastening member passing through the first and second apertures;

a second strap formed of an elastic material with a forward end and a rearward end, and having a first attachment coupling the forward end of the second strap with the platform adjacent to the fastening member and a second attachment coupling the rearward end of the second strap with the platform adjacent to a lateral edge.

3. The footwear system as set forth in claim 2 wherein the first attachment is comprised of the forward end of the second strap formed from a midpoint of the first strap and the second attachment is comprised of the rearward end of the second strap formed as part of a midpoint of the platform.

4. The footwear system as set forth in claim 2 wherein the first attachment is comprised of the forward end of the second strap formed from a midpoint of the first strap and the second attachment is comprised of the rearward end of the second strap coupled to the platform.

5. The footwear system as set forth in claim 2 wherein the first attachment is comprised of the forward end of the second strap coupled to the first strap and the second attachment is comprised of the rearward end of the second strap formed from a midpoint of the platform.

6. A footwear system for protecting a wearer's foot during and following pedicure operations by retaining the foot in place in a safe, comfortable and convenient manner, comprising, in combination:

an essentially oblong platform formed of an elastomeric material having a first aperture offset from a long axis of the platform adjacent to a forward end, a U-shaped cut through a rearward end of the platform forming a first strap disposed toward the forward end with a second aperture through a midpoint of the first strap and aligned with the first aperture, a fastening member passing through the first and second apertures coupling the first strap and the platform and thereby forming two separate passageways, a second strap formed of an elastic material, with a tensile strength different from the first strap and with a forward end and a rearward end, and with a first attachment stitch coupling the forward end of the second strap and the platform adjacent to the fastening member but forwardly thereof, and with a second attachment stitch coupling the rearward end of the second strap and the platform adjacent to a lateral edge thereby enabling a user to place the fifth, fourth, third and second toes on alternate surfaces of the second strap in a serpentine orientation to separate and allow convenient access to the toenails of the user's foot for pedicure operations such as painting the user's toenails.

* * * * *